US005431776A

United States Patent [19]

Richardson et al.

[11] Patent Number: 5,431,776

[45] Date of Patent: Jul. 11, 1995

[54] COPPER ETCHANT SOLUTION ADDITIVES

[75] Inventors: Hugh W. Richardson; Charles F. Jordan, both of Sumter, S.C.

[73] Assignee: Phibro-Tech, Inc., Ft. Lee, N.J.

[21] Appl. No.: 118,429

[22] Filed: Sep. 8, 1993

[51] Int. Cl.[6] ..... B44C 1/22

[52] U.S. Cl. ..... 216/105; 437/245; 437/228; 216/13

[58] Field of Search ..... 156/656, 666, 664, 654, 156/655; 252/79.1, 79.2, 79.5; 437/228, 245, 246

[56] References Cited

U.S. PATENT DOCUMENTS

| | | | |
|---|---|---|---|
| 4,311,551 | 1/1982 | Sykes | 156/640 |
| 4,319,955 | 3/1982 | Murski | 156/659 |
| 4,784,551 | 11/1988 | Cordani et al. | 252/79.4 |
| 4,859,281 | 8/1989 | Goltz | 156/666 |
| 4,892,776 | 1/1990 | Rice | 428/209 |
| 5,043,244 | 8/1991 | Cairncross | 430/247 |
| 5,085,730 | 2/1992 | Cordani | 156/642 |
| 5,243,320 | 9/1993 | Clouser | 338/308 |
| 5,248,398 | 9/1993 | Cordani | 204/106 |

OTHER PUBLICATIONS

Hawley's Condensed Chemical Dictionary, 12th Edition, Van Nostrand Reinhold Company, 1993, p. 1146.

*Primary Examiner*—R. Bruce Breneman
*Assistant Examiner*—Joni Y. Chang
*Attorney, Agent, or Firm*—David P. Gordon

[57] ABSTRACT

Copper etchant solution additives for use with an aqueous alkaline ammoniacal cupric chloride etching bath include several compounds, each of which is shown to stabilize the copper(I) state. The compounds discovered by the present invention include iodide ions such as potassium iodide, ammonium iodide, sodium iodide, calcium iodide and magnesium iodide. Other copper(I) stabilizers discovered by the present invention include certain water soluble salts containing sulfur such as a thiocyanate ion (e.g. ammonium thiocyanate, potassium thiocyanate, sodium thiocyanate, magnesium thiocyanate, and calcium thiocyanate) and a thiosulfate ion (e.g. ammonium thiosulfate, potassium thiosulfate, sodium thiosulfate, magnesium thiosulfate, and calcium thiosulfate). Etching rates for alkaline ammoniacal cupric chloride with different concentrations of potassium iodide, ammonium thiocyanate, and sodium thiosulfate were studied. The results of controlled experiments revealed that adding concentrations up to approximately 1200 mg/L of any one of these compounds to the alkaline ammoniacal cupric chloride etchant resulted in a 20–130% increase in etch rate.

29 Claims, 5 Drawing Sheets

COPPER ETCHANT SOLUTION ADDITIVES

BACKGROUND OF THE INVENTION

1. Field of the Invention

This invention relates to solutions for etching copper in the production of printed wire boards. More particularly, this invention relates to additives for use with an alkaline ammoniacal cupric chloride etching bath which significantly increases the etching rate.

2. State of the Art

Printed wire boards (PWBs), also known as printed circuit boards, are generally manufactured by laminating copper foil onto a non-conductive substrate such as phenolic or epoxy-glass. A circuit is made by applying an etch resistant material to the copper foil in a pattern defining the circuit, and then subjecting the PWB to the action of an etching solution which dissolves all of the copper not covered by the etch resistant material.

Several different types of etching baths may be used. The most commonly used etching bath is alkaline ammoniacal cupric chloride, although an alkaline ammoniacal cupric sulfate bath is sometimes used. Each of these etching baths has advantages and disadvantages. Generally, the chloride baths have a higher etch rate than the sulfate baths. However, additives have been developed which can increase the etch rate of the sulfate baths by up to 100%. U.S. Pat. No. 4,784,785 to Cordani et al. discloses an alkaline ammoniacal copper sulfate etching bath including a mixture of an ammonium halide (preferably 4–5 g/L), a water-soluble salt containing sulfur, selenium or tellurium in the anion (preferably 0.004–0.01 g/L), an organic thio compound containing the group

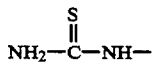

(preferably 0.004–0.01 g/L), and, optionally, a water-soluble salt of a noble metal such as silver (preferably 0.004–0.01 g/L). The sulfate etching bath developed by Cordani et al. has an etch rate almost twice as fast as previously used sulfate baths. Although this is a distinct improvement in the etch rate for the sulfate system, it is still one-half, or less, the rate of an ammoniacal copper chloride bath.

Chloride etching baths have also been improved by certain additives to increase the etching rate. U.S. Pat. No. 4,311,551 to Sykes teaches that the addition of cyanamide, or a cyanamide precursor such as thiourea, in amounts of 0.005–0.3 g/L, to an alkaline ammoniacal cupric chloride bath increases the etching rate by up to 38%. Given the higher etch rate of the chloride baths over the sulfate baths, this 38% increase is significant and chloride baths containing thiourea are the most commonly used today.

A conventional aqueous alkaline ammoniacal cupric chloride etching bath may contain the following ingredients:

| | |
|---|---|
| 1.0–2.8 Moles/L | Cupric ions as metallic copper |
| 2.2–6.2 Moles/L | Ammonium chloride |
| 2.0–9.0 Moles/L | Ammonium hydroxide |
| 0.001–0.10 Moles/L | Ammonium phosphate-di-basic |
| q.s. to 1 liter | Water |

-continued

| | |
|---|---|
| 0.05 to 0.40 g/L | Dithiobiurea or other additive. |

The cupric ions ($Cu^{++}$) are supplied in the etching solution by cupric salts such as cupric chloride, cupric nitrate, cupric acetate, etc. As the etching bath is used to dissolve copper, the resulting oxidized metallic copper and reduced cupric ions cause a buildup of cuprous ions ($Cu^{+}$). These must be oxidized back to the cupric state. A replenisher solution containing ammonium hydroxide, ammonium salts and/or chelating agents and other ingredients is normally used to control the pH range of the system, to make up for the withdrawn complexing agents for the copper and other ingredients, and to dilute the copper concentration to an optimum level.

The use of thiourea as an additive in alkaline ammoniacal cupric chloride etchant baths has remained unquestioned in the industry even though the mechanism of the additive is not fully understood. However, it has recently been suggested that thiourea may be carcinogenic. There is therefore a need to find alternative means for increasing the etching rate of alkaline ammoniacal cupric chloride without using thiourea.

SUMMARY OF THE INVENTION

It is therefore an object of the invention to provide accelerants for accelerating the etching rate of an alkaline ammoniacal cupric chloride etchant without using thiourea.

It is also an object of the invention to provide a copper etching accelerant which stabilizes cuprous ions during the etching process.

It is another object of the invention to provide a relatively inexpensive accelerant for an alkaline ammoniacal cupric chloride etchant which will accelerate the etching rate beyond the rates obtained by the prior art.

In accord with these objects which will be discussed in detail below, the copper etchant solution additives of the present invention include several compounds, each of which is believed to stabilize the copper(I) state (cuprous ions). The accelerant compounds of the present invention include iodide ions such as potassium iodide, ammonium iodide, sodium iodide, calcium iodide and magnesium iodide and other copper(I) stabilizers such as thiocyanate ions (e.g. ammonium thiocyanate, potassium thiocyanate, sodium thiocyanate, magnesium thiocyanate, and calcium thiocyanate) and thiosulfate ions (e.g. ammonium thiosulfate, potassium thiosulfate, sodium thiosulfate, magnesium thiosulfate, and calcium thiosulfate).

Etching rates for alkaline ammoniacal cupric chloride with different concentrations of potassium iodide, ammonium thiocyanate, and sodium thiosulfate were studied. The results of controlled experiments revealed that adding concentrations up to approximately 600 mg/L of any one of these compounds to the alkaline ammoniacal cupric chloride etchant resulted in a 90–130% increase in etch rate.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
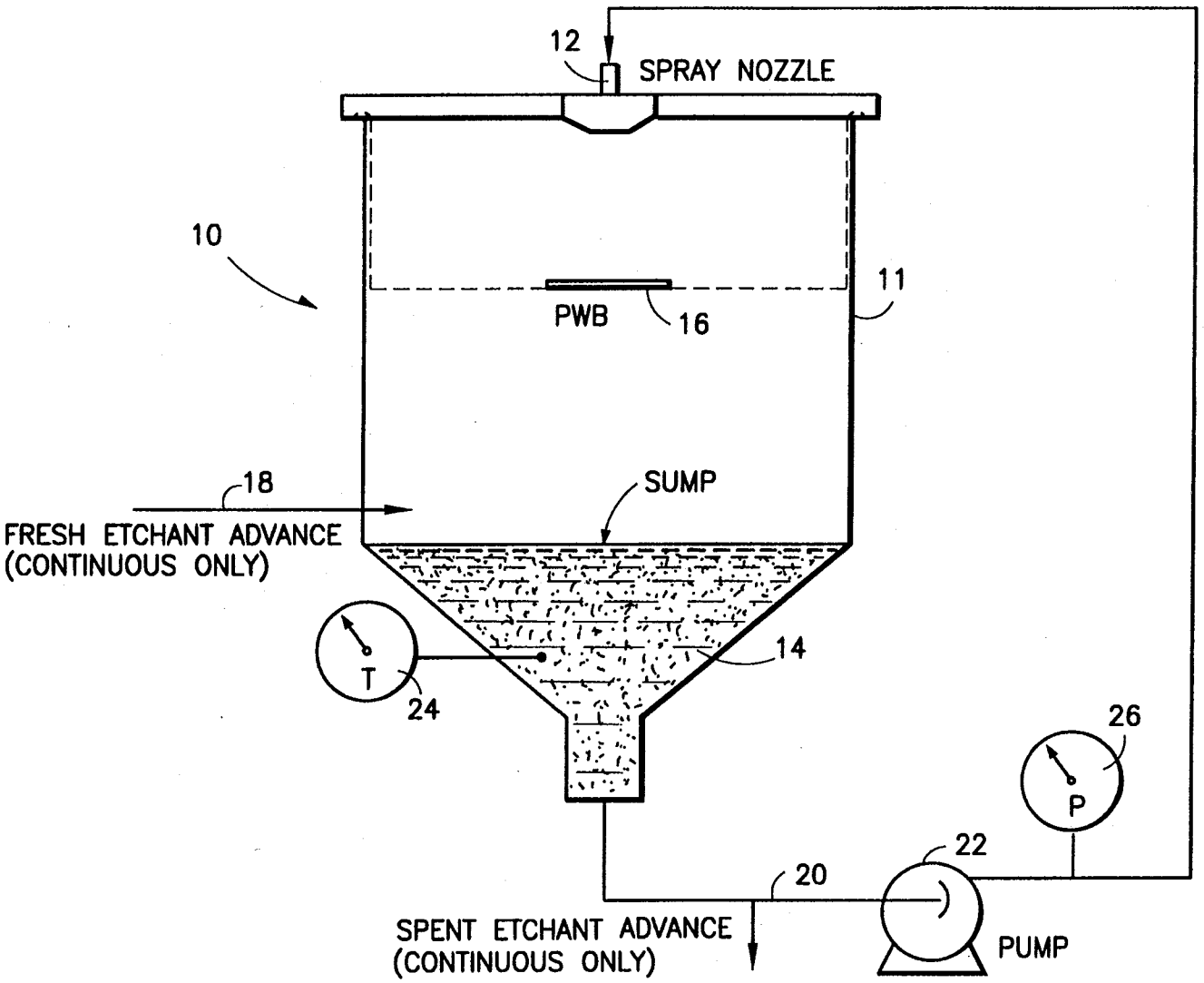
FIG. 1 PRIOR ART
FIG. 1 is a schematic diagram of a prior art PWB etcher and etching process in which the accelerants of the present invention could be used.

Referring now to FIG. 1, the prior art PWB etcher 10 which could use the accelerants of the present invention includes a reactor 11 having a spray nozzle 12 and a sump 14. A printed circuit board 16 of a standard size is located under the nozzle 12 and subjected to the action of a known concentration of copper ammonium chloride. Replenishers can be introduced into the sump via port 18. The etchant in the sump is recycled to the spray nozzle 12 via line 20 and pump 22. The entire process is monitored by temperature sensor 24 and pressure sensor 26.

It is noted that during the etching process, the following reactions take place:

1. $Cu\ (metal) + Cu(NH_3)_4Cl_2 \rightarrow 2Cu\ (NH_3)_2Cl$
2. $2Cu(NH_3)_2Cl + 2NH_3 + 2NH_4Cl + \frac{1}{2}\ O_2 \rightarrow 2Cu(NH_3)_4Cl_2 + H_2)$
3. $2NH_3 + 2NH_4Cl + Cu\ (metal) + \frac{1}{2}\ O_2 \rightarrow Cu(NH_3)_4Cl_2 + H_2O$ The addition of the etchant ($Cu(NH_3)_4Cl_2$) to the metallic copper (Cu) yields a cuprous compound ($Cu(NH_3)_2Cl$). The addition of replenisher ($NH_3$ and $NH_4Cl$) and air to the cuprous compound and to the remaining metallic copper yields more etchant and water. It is believed that the first two reactions are relatively fast, while the third reaction is slower. Both the first and second reactions are two phase, i.e. reaction 1 is liquid and solid and reaction 2 is liquid and gas. Reaction 3 requires contact of gas, liquid and solid for completion. Reaction 3 is actually a combination of the following three processes:

3a. $O_2(gas) \rightarrow O_2(aqueous)$

3b. $2Cu + \frac{1}{2}\ O_2(aqueous) \rightarrow Cu_2O$

3c. $Cu_2O + 2NH_3 + 2NH_4CL \rightarrow 2Cu(NH_3)_2Cl$

It is believed that the surface oxidation of copper with oxygen in reaction **3*b* is self-limiting by formation of a protective copper(I) oxide film over the surface of the metal. The oxide coating needs to be removed by dissolution for reaction 1** (the reverse disproportionation reaction) to be able to occur. The copper(I) stabilizing moiety has particular affinity for the copper(I) oxide and should facilitate its removal.

Using the hypothesis of the invention that agents which stabilize the copper(I) state accelerate the etching process, several experiments were carried out in a reactor such as shown in FIG. 1 using different additives in the sump. First, a copper ammonium chloride etchant was tested without any additives to determine a baseline etch rate which was assigned the relative value of 1 for comparison purposes.

The etchant used to determine the baseline was composed of:

| | |
|---|---|
| Cu | 2.5M |
| $NH_4Cl$ | 5.6M |
| $(NH_4)_2CO_3$ | 0.23M |
| $NH_3$ | to adjust pH to 8.3–8.5 |
| $(NH_4)_2HPO_4$ | 0.008M |

According to the invention, compounds believed to stabilize the copper(I) state (cuprous ions) include iodide ions (e.g. potassium iodide, ammonium iodide, sodium iodide, calcium iodide and magnesium iodide), thiocyanate ions (e.g. ammonium thiocyanate, potassium thiocyanate, sodium thiocyanate, magnesium thiocyanate, and calcium thiocyanate), and thiosulfate ions (e.g. ammonium thiosulfate, potassium thiosulfate, sodium thiosulfate, magnesium thiosulfate, and calcium thiosulfate).

EXAMPLE 1

Figure 2:
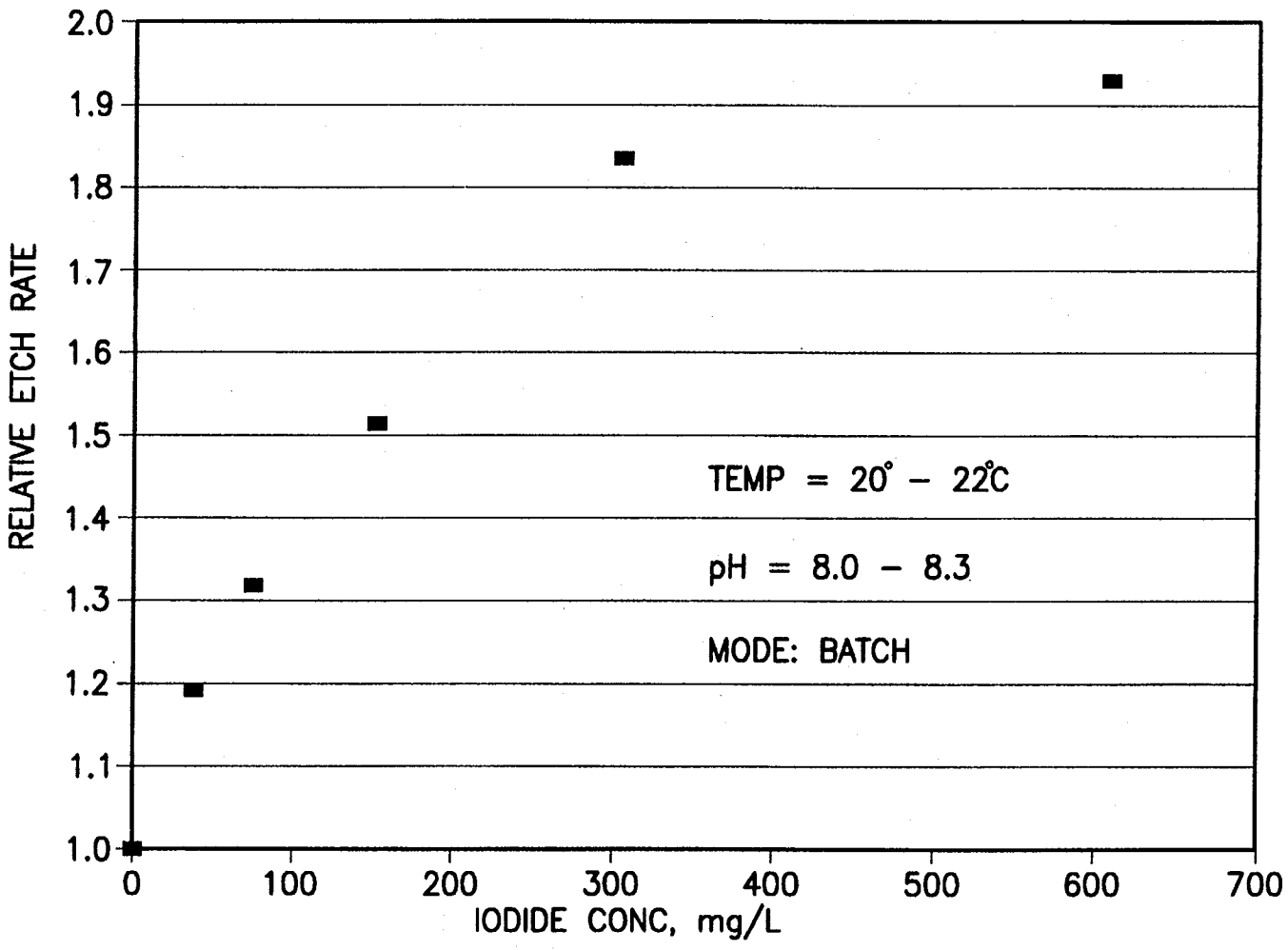
FIG. 2 is a graph of the relative etch rate as a function of iodide ion concentration in the etchant.

Five experiments were conducted using increasing concentrations of potassium iodide added to the etchant described above. The tests were all conducted at a temperature of 20°–22° C. and a pH of 8.0–8.3. FIG. 2 shows the results of the tests expressed as a relative etch rate for each concentration tested. It will be noted that the addition of iodide ion in concentrations of 50 mg/L through 200 mg/L results in a rapid rise in the relative etch rate. After about 200 mg/L, the relative etch rate continues to rise, though somewhat less dramatically. At the maximum concentration tested (600 mg/L), the relative etch rate was approximately 1.93 or a 93% increase in etch rate as compared to the etchant without potassium iodide added. Similar results were observed in informal trials at temperatures up to 50° C.

EXAMPLE 2

Figure 3:
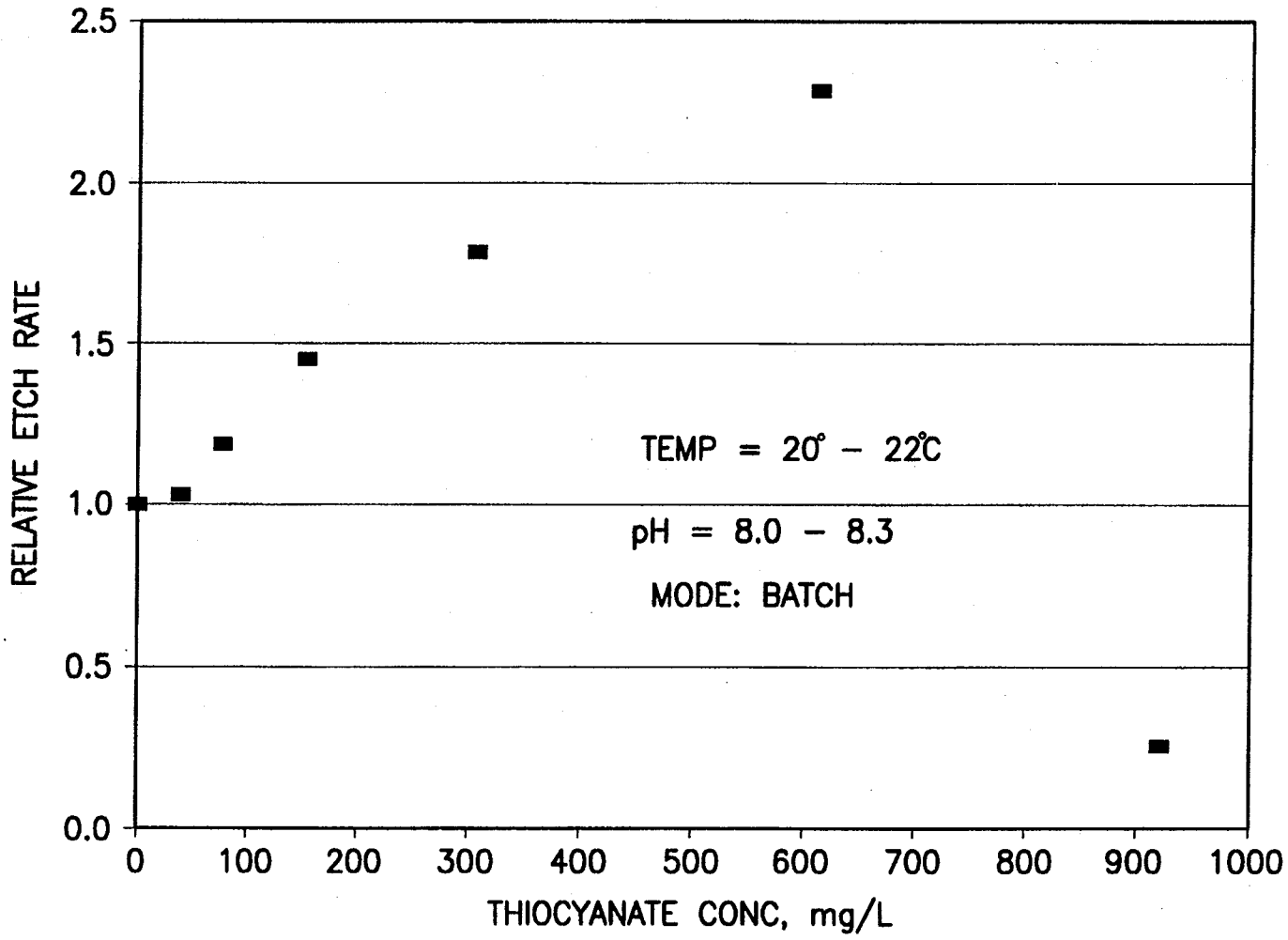
FIG. 3 is a graph of the relative etch rate as a function of thiocyanate ion concentration in the etchant.

Six experiments were conducted using increasing concentrations of ammonium thiocyanate added to the etchant described above. The tests were all conducted at a temperature of 20°–22° C. and a pH of 8.0–8.3. FIG. 3 shows the results of the tests expressed as a relative etch rate for each concentration tested. It will be noted that the addition of thiocyanate ion in concentrations up to 600 mg/L resulted in a steady rise in the relative etch rate. At 900 mg/L, however, the relative etch rate dropped dramatically. The best results were achieved at a concentration of 600 mg/L where the relative etch rate was approximately 2.3 or a 130% increase in etch rate as compared to the etchant without ammonium thiocyanate added. Similar results were observed in informal trials at temperatures up to 50° C.

EXAMPLE 3

Figure 4:
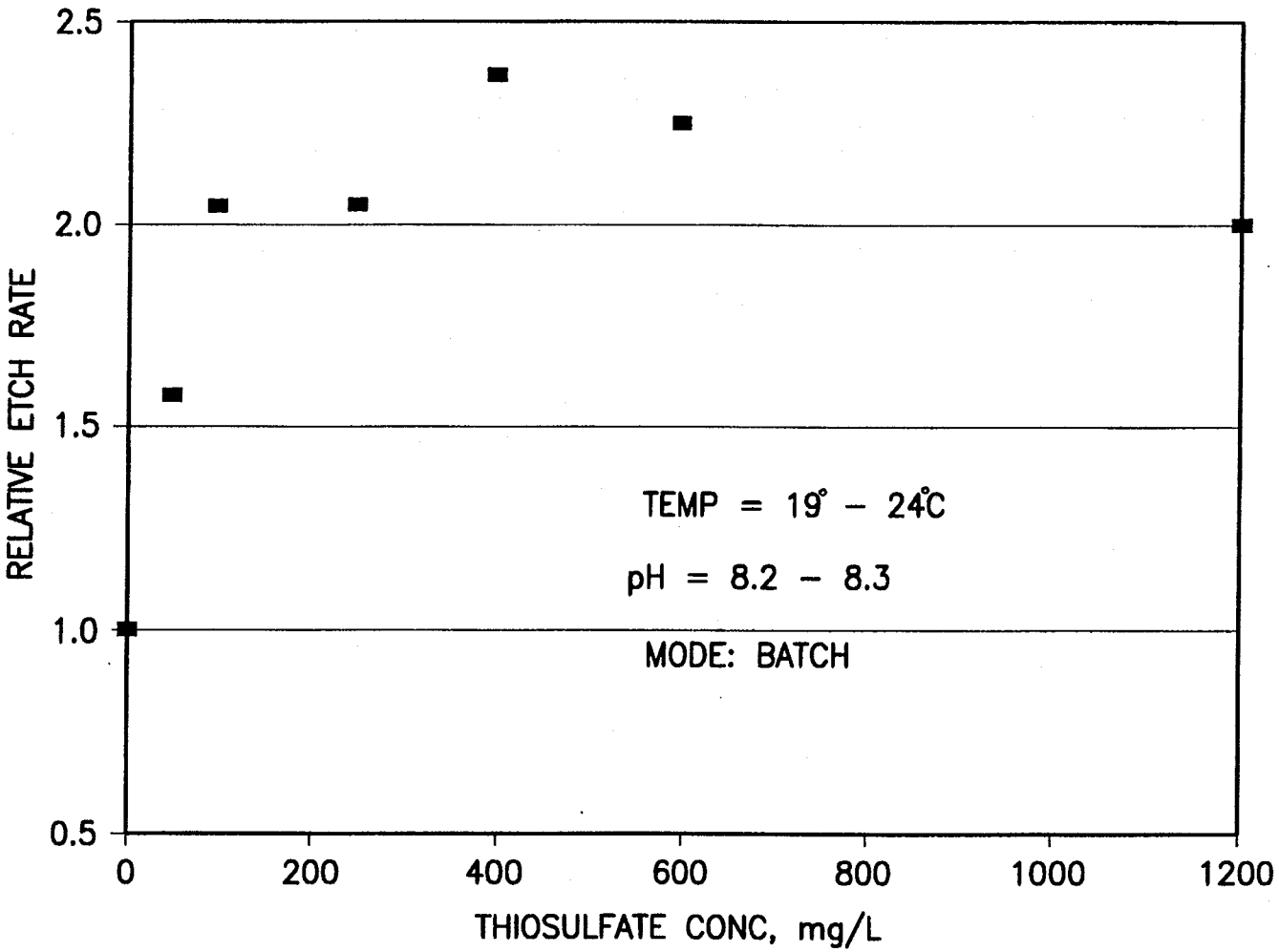
FIG. 4 is a graph of the relative etch rate as a function of thiosulfate ion concentration in the etchant.

Five experiments were conducted using increasing concentrations of sodium thiosulfate added to the etchant described above. The tests were all conducted at temperatures between 19°–24° C. and a pH of 8.2–8.3. FIG. 4 shows the results of the tests expressed as a relative etch rate for each concentration tested. It will be noted that the addition of thiosulfate ion in concentrations up to about 200 mg/L resulted in dramatic increases in the relative etch rate. The relative etch rate continued to increase, though less dramatically, in response to concentrations as high as 400 mg/L. At 600 mg/L, however, the relative etch rate dropped slightly. The best results were achieved at a concentration of 400 mg/L where the relative etch rate was approximately 2.3 or a 130% increase in etch rate as compared to the etchant without thiosulfate ion added. Similar results were observed in informal trials at temperatures up to 50° C.

Based on the experiments conducted, the preferred embodiment of the invention is the use of a thiosulfate ion accelerant in concentration of 50 to 400 mg/L (400 mg/L preferred) at temperatures up to 50° C.

EXAMPLE 4

Figure 5:
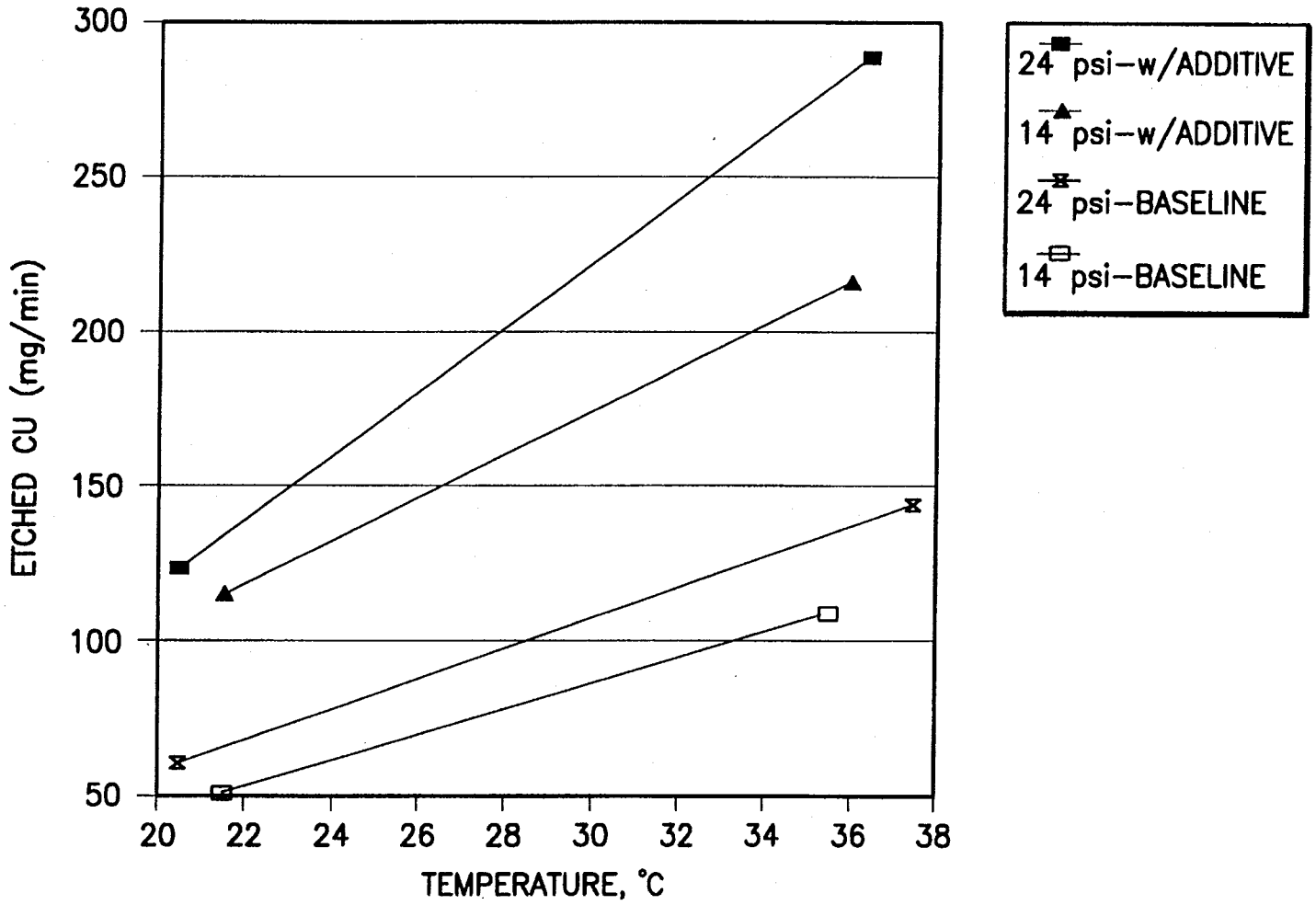
FIG. 5 is a comparison graph of the relative etch rate with and without the inventive additive at different temperatures and pressures.

Eight experiments were conducted at different temperatures and pressures to confirm the results of the above experiments. The baseline etchant was tested at 14 psi in two experiments, one at 21.5° C. and one at 35.5° C. and at 24 psi in two experiments, one at 20.5° C. and one at 37.5° C. Etching rates were measured in milligrams of copper etched per minute. The baseline etchant was then tested with 400 mg/L of the thiosulfate ion as an additive at substantially the same pressures and temperatures. All of the tests were conducted with an 8.1 $cm^2$ coupon of copper laminate with a density of 1 ounce copper per square foot. The graph in FIG. 5 shows the results of these eight experiments in a simplified form. From FIG. 5, it was concluded that the additive increases the etch rate by approximately the same factor regardless of the temperature or pressure.

There have been described and illustrated herein several embodiments of an accelerant for use in an alkaline ammoniacal cupric etching bath. While particular embodiments of the invention have been described, it is not intended that the invention be limited thereto, as it is intended that the invention be as broad in scope as the art will allow and that the specification be read likewise. Thus, while particular concentrations have been disclosed, it will be appreciated that other concentrations within the ranges claimed could be utilized. Also, while particular copper(I) stabilizers have been shown, it will be recognized that other types of copper(I) stabilizers could be used according to the teachings of the present invention to obtain similar results. Further, it will be appreciated that while particular iodide, thiocyanate, and thiosulfate salts have been mentioned, other salts could be utilized (e.g., copper, lithium, etc.) It will therefore be appreciated by those skilled in the art that yet other modifications could be made to the provided invention without deviating from its spirit and scope as so claimed.

We claim:

1. An aqueous alkaline ammoniacal cupric chloride etching bath containing an etch accelerating additive selected from the group consisting of copper(I) stabilizers, said additive being present in an amount sufficient to increase the etch rate of said bath by at least 40 percent over an identical etching bath free of said additive.

2. An etching bath according to claim 1, wherein: said additive is a compound selected from the group consisting of an iodide salt, a thiocyanate ion, and a thiosulfate ion.

3. An etching bath according to claim 1, wherein: said additive is potassium iodide.

4. An etching bath according to claim 1, wherein: said additive is ammonium thiocyanate.

5. An etching bath according to claim 1, wherein: said additive is sodium thiosulfate.

6. An etching bath according to claim 1, wherein: said additive is present in an amount less than 1200 mg/L of said bath.

7. An etching bath according to claim 6, wherein: said additive is present in an amount greater than 50 mg/L of said bath.

8. An etching bath according to claim 6, wherein: said additive is present in an amount less than 700 mg/L of said bath.

9. An etching bath according to claim 6, wherein: said additive is present in an amount less than 500 mg/L of said bath.

10. An etching bath according to claim 7, wherein: said additive is selected from the group consisting of potassium iodide, ammonium iodide, sodium iodide, calcium iodide and magnesium iodide.

11. An etching bath according to claim 2, wherein: said additive is selected from the group consisting of ammonium thiocyanate, potassium thiocyanate, sodium thiocyanate, magnesium thiocyanate, and calcium thiocyanate.

12. An etching bath according to claim 2, wherein: said additive is selected from the group consisting of ammonium thiosulfate, potassium thiosulfate, sodium thiosulfate, magnesium thiosulfate, and calcium thiosulfate.

13. An etching bath according to claim 6, wherein: said additive is a compound selected from the group consisting of a thiocyanate ion and a thiosulfate ion.

14. An aqueous alkaline ammoniacal cupric chloride etching bath containing an etch accelerating additive selected from the group consisting of an iodide ion, a thiocyanate ion, and a thiosulfate ion, said additive being present in an amount sufficient to increase the etch rate of said bath over an identical etching bath free of said additive.

15. An etching bath according to claim 14, wherein: said additive is present in an amount less than 1200 mg/L and more than 50 mg/L.

16. An etching bath according to claim 14, wherein: said additive is selected from the group consisting of potassium iodide, ammonium thiocyanate, and sodium thiosulfate.

17. An etching bath according to claim 16, wherein: said additive is present in an amount less than 1200 mg/L and more than 50 mg/L.

18. An etching bath according to claim 14, wherein: said additive is present in an amount less than 700 mg/L and more than 100 mg/L.

19. An etching bath according to claim 17, wherein: said additive is present in an amount less than 700 mg/L and more than 100 mg/L.

20. A method for accelerating the etch rate of an aqueous alkaline ammoniacal cupric chloride etching bath suitable for use in etching a printed wire board, said method comprising:

adding an etch accelerating additive selected from the group consisting of copper(I) stabilizers, said additive being added to the etching bath in an amount sufficient to increase the etch rate of the bath over an identical etching bath free of said additive.

21. A method according to claim 20, wherein: said additive is a compound selected from the group consisting of an iodide salt, a thiocyanate ion, and a thiosulfate ion.

22. A method according to claim 21, wherein: said additive is selected from the group consisting of potassium iodide, ammonium iodide, sodium iodide, calcium iodide, magnesium iodide, ammonium thiocyanate, potassium thiocyanate, sodium thiocyanate, magnesium thiocyanate, calcium thiocyanate, ammonium thiosulfate, potassium thiosulfate, sodium thiosulfate, magnesium thiosulfate, and calcium thiosulfate.

23. A method according to claim 21, wherein:

said additive is present in an amount less than 1200 mg/L and more than 50 mg/L.

24. A method according to claim 21, wherein:

said additive is added to the etching bath in an amount sufficient to increase the etch rate of the bath by at least 40 percent over an identical etching bath free of said additive.

25. A method according to claim 20, further comprising:

subjecting a masked copper clad printed wire board to the aqueous alkaline ammoniacal cupric chloride etching bath including said etch accelerating additive.

26. A method according to claim 25, wherein:

said additive is a compound selected from the group consisting of an iodide salt, a thiocyanate ion, and a thiosulfate ion.

27. A method according to claim 26, wherein:

said additive is selected from the group consisting of potassium iodide, ammonium iodide, sodium iodide, calcium iodide, magnesium iodide, ammonium thiocyanate, potassium thiocyanate, sodium thiocyanate, magnesium thiocyanate, calcium thiocyanate, ammonium thiosulfate, potassium thiosulfate, sodium thiosulfate, magnesium thiosulfate, and calcium thiosulfate.

28. A method according to claim 26, wherein:

said additive is present in an amount less than 1200 mg/L and more than 50 mg/L.

29. A method according to claim 26, wherein:

said additive is present in said etching bath in an amount sufficient to increase the etch rate of said bath by at least 40 percent over an identical etching bath free of said additive.

* * * * *